US007497354B2

(12) United States Patent
Decottignies et al.

(10) Patent No.: US 7,497,354 B2
(45) Date of Patent: Mar. 3, 2009

(54) FLUID DISPENSER

(75) Inventors: Laurent Decottignies, Cergy (FR); Yannick Herve, Breteuil (FR)

(73) Assignee: Airlessystems, Charleval (FR)

( * ) Notice: Subject to any disclaimer, the term of this patent is extended or adjusted under 35 U.S.C. 154(b) by 435 days.

(21) Appl. No.: 10/530,680

(22) PCT Filed: Oct. 6, 2003

(86) PCT No.: PCT/FR03/02923

§ 371 (c)(1),
(2), (4) Date: Apr. 8, 2005

(87) PCT Pub. No.: WO2004/033111

PCT Pub. Date: Apr. 22, 2004

(65) Prior Publication Data

US 2006/0000926 A1 Jan. 5, 2006

(30) Foreign Application Priority Data

Oct. 9, 2002 (FR) ..... 02 12536

(51) Int. Cl.
*B67D 5/52* (2006.01)

(52) U.S. Cl. ..... 222/135; 222/129; 239/304

(58) Field of Classification Search ..... 222/135, 222/137, 94, 95, 136, 183, 131, 145.1, 142.3, 222/145.5, 129, 100, 105, 180, 628; 239/302–304
See application file for complete search history.

(56) References Cited

U.S. PATENT DOCUMENTS

| | | | | |
|---|---|---|---|---|
| 5,411,176 | A * | 5/1995 | Favre | 222/94 |
| 6,308,863 | B1 * | 10/2001 | Harman | 222/135 |
| 6,722,532 | B2 * | 4/2004 | Lasserre et al. | 222/137 |
| 7,063,235 | B2 * | 6/2006 | Auer | 222/135 |
| 2002/0117516 | A1 | 8/2002 | Lasserre-Pierre et al. | |

FOREIGN PATENT DOCUMENTS

JP 11-000587 A 4/1999

* cited by examiner

*Primary Examiner*—Lien T Ngo
(74) *Attorney, Agent, or Firm*—Sughrue Mion, PLLC

(57) ABSTRACT

A fluid dispenser comprising:

two distinct dispenser units (1), each comprising a fluid reservoir (20) defining an opening (23), a dispenser member (3) for taking and dispensing the fluid from the reservoir, and a fastener member (4) for fastening the dispenser member (3) on the opening (23) of the reservoir (20); and a common outer shell (6) in which at least the two reservoirs (20) are housed, said dispenser being characterized in that the shell (6) includes receiver means (62) for receiving and holding the two dispenser units (1) inside the shell.

6 Claims, 3 Drawing Sheets

FLUID DISPENSER

The present invention relates to a particular fluid dispenser commonly referred to by the expression "dual dispenser" because it comprises two often distinct dispenser units, each comprising: a fluid reservoir defining an opening; a dispenser member for taking and dispensing the fluid from the reservoir; and a fastener member for fastening the dispenser member on the opening of the reservoir. In general, the dispenser member is a pump, but sometimes, it can also be a valve. In addition, the opening of the reservoir is often in the form of a neck which projects above a reservoir body for containing the fluid. With regard to the fastener member, it is often in the form of a ring, inside which the dispenser member is fastened, together with fastener means for providing a secure and often sealed fastening on the opening or the neck of the reservoir. That type of dual dispenser finds an advantageous application when two base substances must be mixed only at the last moment. Such dual dispensers can be used in the fields of pharmacy, cosmetics, or even perfumery.

In general, each dispenser unit includes an actuator rod through which the fluid flows each time actuation takes place. In the particular case of the dual dispenser comprising two dispenser units, given that it could also comprise three or even more units, the two actuator rods are covered by a common dispenser head which can be pressed so as to actuate both actuator rods of the two units simultaneously. In addition, it is also known to use an outer shell in which the two units are installed. In general, the shell covers at least the two reservoirs, leaving at least the two actuator rods of the two units projecting out from the shell. In conventional manner, the shell includes a bottom wall which serves as a bearing surface for the two dispenser units. The units thus rest on the bottom wall of the shell. In general, it is possible to use a closure cover which is disposed and fastened on the top end of the shell, so as to keep the two dispenser units in place inside the shell.

That type of configuration does not offer any modularity, given that it is always necessary to use the same kind of dispenser units to make the dual dispenser. Given that each reservoir of a unit rests on the bottom wall of the shell, it is not possible, for example, to modify the volume of the reservoir of a unit, given that its actuator rod would then no longer project out from the shell.

In the prior art, document U.S. 2002/0117516 is known which describes a dual dispenser comprising aerosol cans and a housing. Each can comprises a receptacle, a valve, and a clamping ring for fastening the valve on the opening of the receptacle. The housing defines two receiver tubes provided with inner fastener profiles. The cans are held respectively in their receiver tubes at their clamping rings in engagement with the fastener profiles. In addition, the housing covers the top of the aerosol cans, leaving their bottom portions visible. The preamble of claim 1 is based on that document.

An object of the present invention is to remedy the above-mentioned prior-art drawback by defining a fluid dispenser of the dual type that offers significant modularity concerning the dispenser units that can be integrated therein. In particular, it could use units having reservoirs that present different capacities.

To achieve this object, the present invention proposes a fluid dispenser comprising: two distinct dispenser units, each comprising a fluid reservoir defining an opening, a dispenser member for taking and dispensing the fluid from the reservoir, and a fastener member for fastening the dispenser member on the opening of the reservoir; and a common outer shell in which at least the two reservoirs are housed, the shell including receiver means for receiving and holding the two dispenser units inside the shell. Each dispenser unit thus advantageously includes holding means for co-operating with the receiver means of the shell for holding the respective unit separately inside the shell. The fastener member preferably forms the holding means. Thus, each dispenser unit is held in distinct manner by its fastener member, i.e. at the opening of the reservoir, in the receiver means formed by the shell. Thus, the reservoir in a unit no longer need to rest on the bottom wall of the shell, such that the shell does not even need to form a bottom wall, which can thus advantageously be a separate fitted piece. The units can be snap-fastened in the receiver means either via the open bottom of the shell, or via the top of the shell. It will thus be easily understood that it is possible to use reservoirs of different capacities or of different shapes, given that the configuration of the reservoir, or at least its height, is no longer tied to the configuration of the outer covering shell. This implies significant modularity concerning the dispenser units that can be integrated in the dispenser. In addition, given that each dispenser unit is completely distinct, and prior to assembly forms inside its shell two units that are completely equivalent and interchangeable, there is no problem in disposing the units inside the shell. The only connections between the two units are constituted by the receiver means of the shell and the common dispenser head which comes to cover the two dispenser units. However, it is possible to envisage applications in which there is no common dispenser head, but, on the contrary, two separate dispenser heads.

In an embodiment, the receiver means form two snap-fastener housings, the holding means forming a peripheral profile for snap-fastening in a respective housing. The fact of providing two separate snap-fastener housings clearly shows the independence of the dispenser units, and consequently the modularity of the dispenser. The holding means advantageously include a radial flange that extends outwards.

According to another characteristic of the invention, the dispenser can further comprise blocking means for blocking the dispenser units in the receiver means. The blocking means advantageously comprise a cup fastened on the shell, and coming into blocked engagement with the dispenser units. Advantageously, the dispenser further comprises a dispenser head for actuating the two units simultaneously, the cup forming a sleeve having the dispenser head slidably engaged on its inside or its outside, the sleeve including retention means suitable for preventing the head from being removed from the sleeve. The dispenser head is preferably adapted to be mounted on actuator rods of the respective units, the retention means enabling the head to be prepositioned on the actuator rods, the final mounting of the head on the rods taking place while the dispenser is being actuated for the first time.

According to another characteristic, the shell is provided with a bottom wall, and the reservoirs do not come into bearing contact against the bottom wall.

According to another characteristic, the receiver means may be formed integrally as a single piece with the shell.

According to another aspect, the dispenser units may be engaged in the receiver means via the top, such that the reservoirs penetrate firstly into the shell via the receiver means. The receiver means advantageously comprise two housings, each comprising snap-fastener profiles and bearing surfaces, the holding means including a flange defining a top face engaged with the snap-fastener profiles, and a bottom face engaged with the bearing surfaces. Preferably, the dispenser further comprises a dispenser head that is displaceable by bearing axially in such a manner as to press the bottom face of the flange against the bearing surfaces.

The invention is described more fully below with reference to the accompanying drawings which show an embodiment of the present invention by way of non-limiting example.

Figure 1:
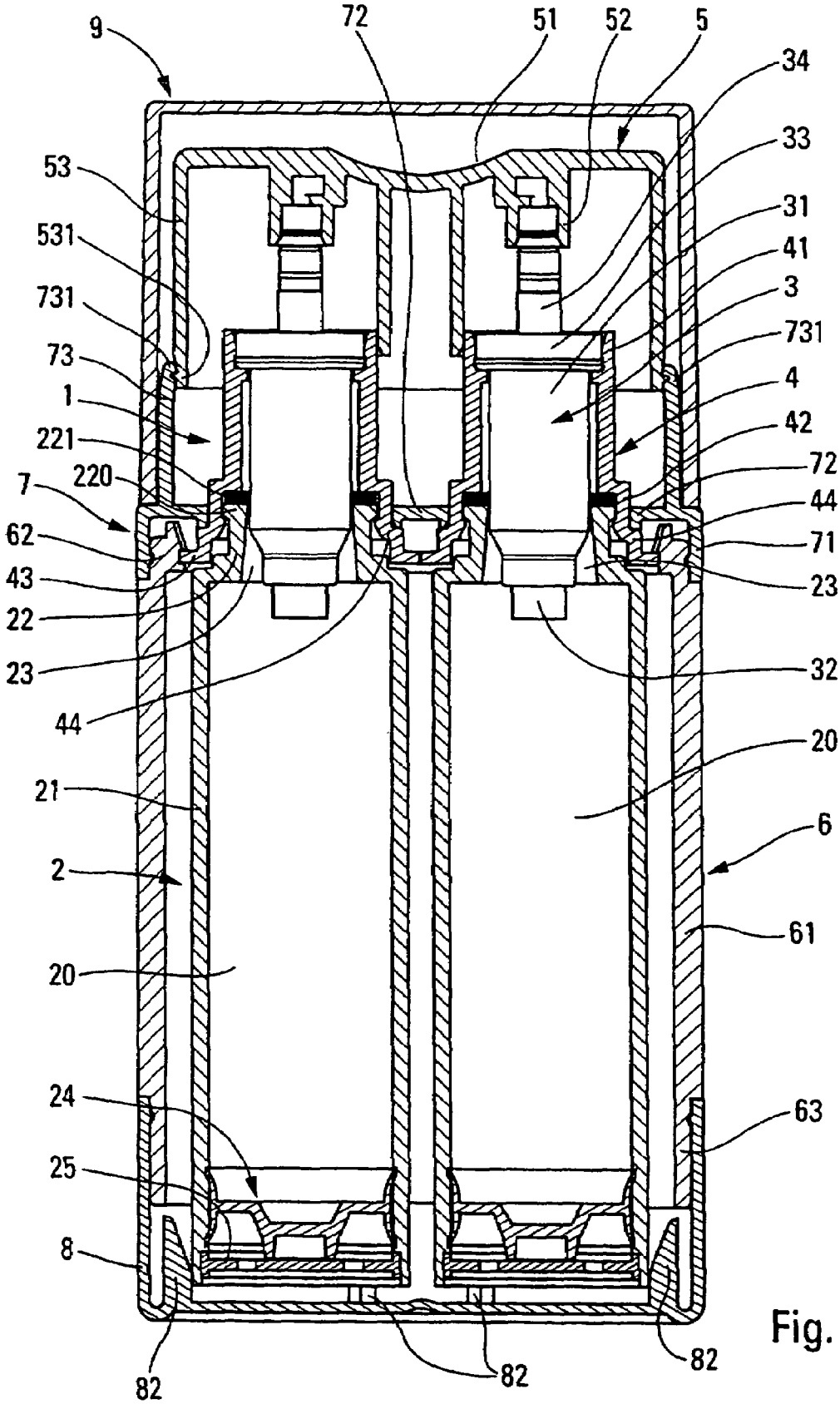
FIG. 1 is a vertical section view through a dispenser constituting an embodiment of the invention.

The dual dispenser of the invention shown in the figures comprises two dispenser units 1, and an outer shell 6 in which the two dispenser units are housed, at least in part. The two dispenser units are associated with a common dispenser head 5, but two separate heads connected by any means could also be envisaged. In addition, the dispenser comprises a bottom wall 8 connected to the bottom end of the shell 6, a cup 7 associated with the top end of the shell 6, and a cover 9 which comes to cover the dispenser head 5 and which co-operates with the cup 7. The bottom wall 8, the cup 7, and the cover 9 are optional, but advantageous.

Figure 2:
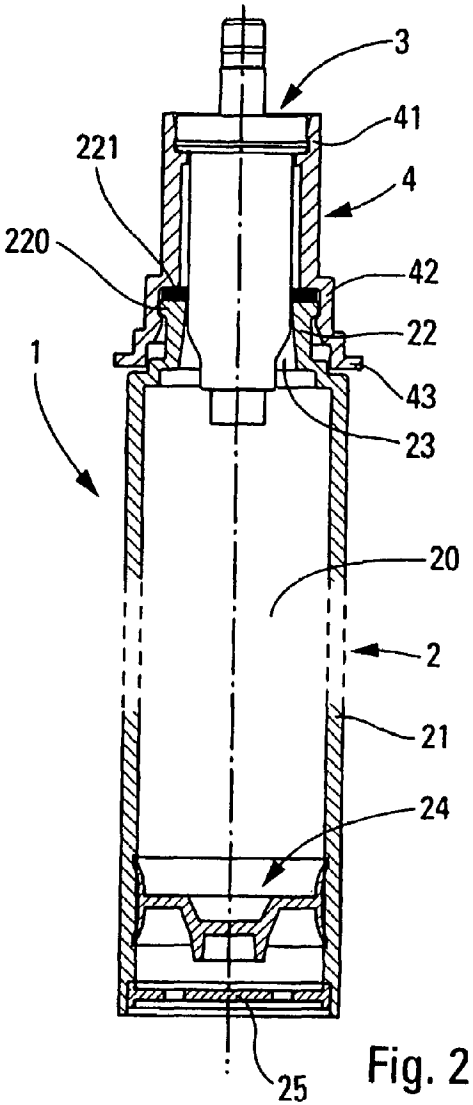
FIG. 2 is a view of a dispenser unit integrated in the FIG. 1 dispenser.
Figure 3:
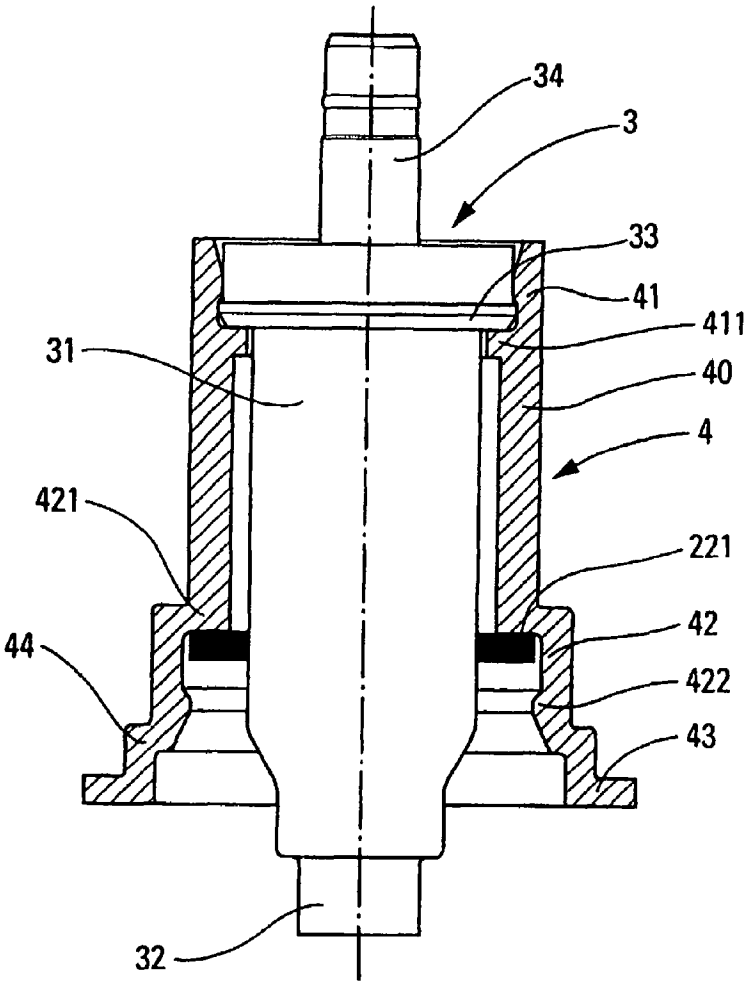
FIG. 3 is a larger-scale view of the dispenser member and of the fastener member of the dispenser unit shown in FIG. 2.

Reference is made firstly to FIGS. 2 and 3 in order to explain the structure of a dispenser unit used in the dual dispenser of the present invention. The dispenser unit is designated overall by numerical reference 1. It comprises a receptacle 2 defining a barrel 21 that is advantageously cylindrical, and at the top end of which is formed a neck 22 defining an opening 23 which puts the inside of the barrel 21 into communication with the outside. In addition, the bottom end of the barrel 21 is provided with a bottom-wall element 25 that is advantageously fitted inside the barrel 21. The barrel 21 also comprises a wiper or follower piston 24 which is engaged inside the barrel 21 so as to be able to slide therein in sealed manner. Thus, a portion of the barrel 21, the neck 22, and the follower piston 24 together form a volume which defines a reservoir 20 for containing the fluid. The follower piston 24 is designed to be displaced towards the opening 23 as the fluid contained in the reservoir 20 is extracted therefrom. Thus, the fluid stored inside the reservoir 20 is never in contact with ambient air while still inside the reservoir 20. It should also be observed that the neck 22 is formed with an outer reinforcement 220 which defines the top end of the neck.

By way of example, the receptacle can be replaced by a pouch system comprising a flexible pouch associated with a rigid support pouch engaged with the fastener member. Other receptacles can also be envisaged.

The receptacle 2 is associated with a dispenser member 3 and a fastener member 4, as shown in larger scale in FIG. 3. The dispenser member 3, which in this case is preferably a pump, comprises a body 31 defining, at its bottom end, an inlet duct 32 communicating with the inside of the reservoir 20. At its top end, the body 31 forms a snap-fastener collar 33 which projects radially outwards. Beyond the collar 33, the dispenser member comprises an actuator rod 34 that is axially displaceable inside the body 31. The actuator rod 34 defines an internal flow duct through which the fluid taken and delivered by the pump 3 is dispensed. In addition, the fastener member 4 comprises receiver means 41 for receiving the snap-fastener collar 33 of the body 31 of the pump 3 by snap-fastening. The receiver means 41 comprise an inner peripheral flange 411 on which the collar 31 comes to bear. The receiver means 41 are situated at the top end of the fastener member. Below the receiver means 41, the fastener member forms a turret 40 which is in the form of a substantially cylindrical section disposed concentrically around the body 31, leaving an intermediate annular gap. At its bottom end, the turret 40 forms a shoulder 421 which extends radially outwards. The shoulder 421 serves as a bearing surface for an O-ring 221 which is advantageously pre-engaged and held by friction around the body 31 of the pump 3, as can be seen very clearly in FIG. 3. Beyond the shoulder 421, the fastener member forms snap-fastening fastener means 42 defining a snap-fastener housing that is closed in part by a peripheral bead 422 which extends inwards. The fastener means 42 are for receiving the outer peripheral reinforcement 220 formed by the neck 22. The housing formed by the fastener means 42 is designed so that the top end of the neck 22 is received securely inside the housing, compressing the O-ring 221 against the shoulder 421. Below the fastener means 42, the fastener member forms an outwardly-directed second shoulder 44 having a function that is described below. Below the shoulder 44, the fastener member forms a peripheral radial flange 43 which extends outwards. Its function is also described below.

Thus, once the fastener member 4 is snap-fastened on the neck 22 of the receptacle 2, a sub-assembly is obtained forming the dispenser unit 1 shown in FIG. 2. The dual dispenser of the present invention integrates two dispenser units of this type. It is preferable, and even essential, for all the units to include identical flanges 43. In addition, it is preferable for the distance between each flange 43 and the top end of the actuator rod 34 to be identical for all the units. However, the fastener member and the dispenser member can vary from one unit to another. In addition, the receptacles 2 can vary in shape, i.e. in height or in width.

Figure 4:
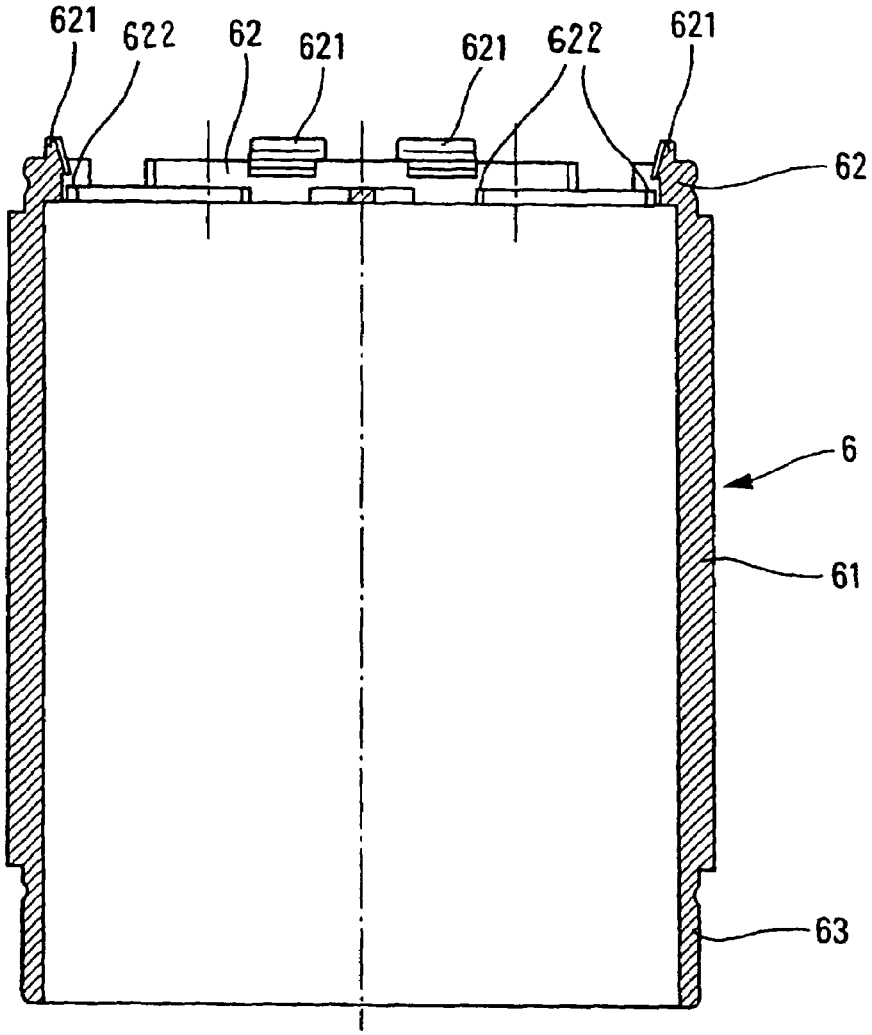
FIG. 4 is a vertical section view through the shell of the FIG. 1 dispenser.
Figure 5:
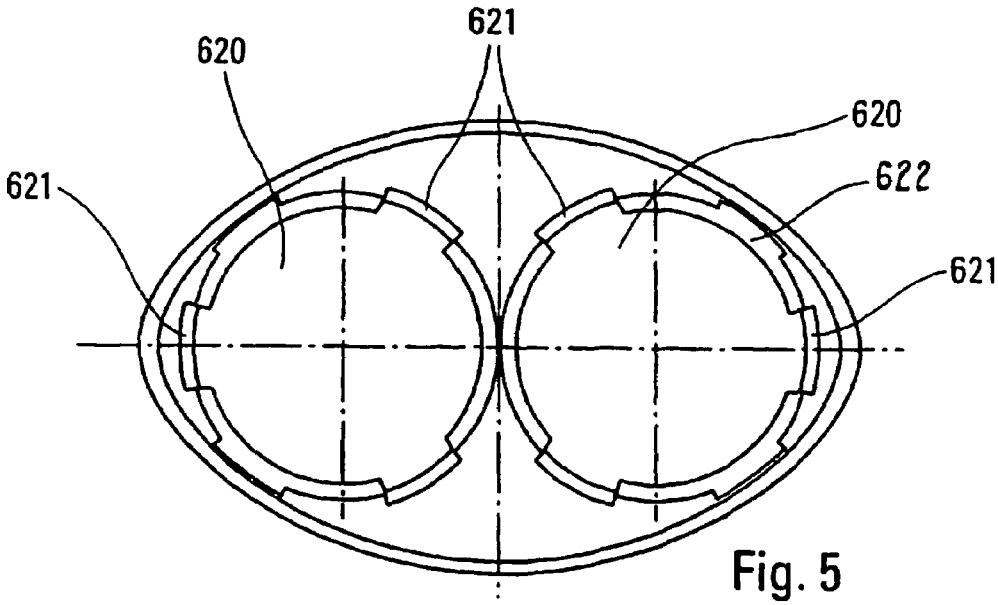
FIG. 5 is a plan view of the shell shown in FIG. 4.

Reference is made below to FIGS. 4 and 5 which show an embodiment of an outer covering shell used in the FIG. 1 dispenser. The shell 6 is roughly in the form of a cylinder of oval or of elliptical section, as can be seen in FIG. 5. The shell 6 thus comprises a substantially cylindrical barrel 61 which is terminated at its bottom end by a snap-fastener endpiece 63 for co-operating with a separate bottom wall 8, as can be seen in FIG. 1. At its top end, the barrel 61 defines receiver means 62, which, in this case, are in the form of two housings 620 bordered by snap-fastener profiles 621 and bearing surfaces 622. The snap-fastener profiles 621 and the bearing surfaces 622 can extend around the entire periphery of the housings 620, or as shown in FIGS. 4 and 5, they can be located only locally in the form of sectors. Each housing 620 forms a flow opening putting the inside of the barrel 61 into communication with the outside. It should be observed that the shell 6 is advantageously symmetrical about a plane passing between the two housings 620, as can be seen in FIG. 5. The shell surrounds the receptacles 2 at least in part, the necks 22 being able to project out from the shell. The shell could extend over a portion only of the height of the barrel 61, or it could be made with windows.

In the invention, the receiver means 62 are for co-operating with the flanges 43 that form holding means. More precisely, the outer peripheral edges of the flanges 43 are for co-operating with the snap-fastener profiles 621 formed around the housings 620. Thus, each dispenser unit 1 can be inserted via the top and held in the shell 6 at a housing 620 initially by passing the reservoir 2 through the housing 620 until the flange 43 can be forcibly snap-fastened below the snap-fastener profiles 621 on the edge surfaces. The top face of the flange becomes engaged with the snap-fastener profiles, and the bottom face with the edge surfaces. The receiver means can also include screw-fastener means instead of snap-fastener sectors. Each dispenser unit is thus put into place and fastened in completely separate and independent manner. The dispenser units 1 are thus connected to the shell 6 only at the housings 620. The separate bottom wall 8 can optionally include centering means 82, which can be in the form of vertical bars for coming into engagement with the bottom end of the barrel 21 for centering the receptacles 2 inside the shell 6. However, the centering means 82 do not assist in fastening the dispenser units 1 in the shell 6.

It should thus be understood that it is possible to mount any dispenser member in a housing of the shell so long as its snap-fastener flange 43 is adapted to co-operate with the retaining means of the shell. Given that the receptacle 2 of the unit does not rest on the bottom wall 8 of the shell, two dispenser units having reservoirs of different volumes can even be envisaged.

According to another advantageous characteristic of the invention, a cup 7 is fastened on the shell 6. The cup comes to block the two dispenser units permanently in the receiver means 62 of the shell. The cup 7 comprises an outer skirt 71 that is snap-fastened around the top end of the shell 6 where the receiver means 62 are formed. In addition, the cup 7 forms a blocking wall 72 pierced with two openings having peripheral edges that come into engagement with the respective dispenser units, advantageously at the shoulders 44 formed by the fastener member 4. Thus, the cup reinforces the fastening of the dispenser units on the shell 6. In addition, the cup 7 forms a sleeve 73 which extends freely upwards. The outer wall of the sleeve 73 advantageously comes into friction contact with the inner wall of a cover 9 which is for covering the dispenser units and which comes into abutment against the outer skirt 71. This characteristic is conventional for a protective cover. In addition, the inner wall of the sleeve 73 forms retention means 731 having a function that is described below.

In the invention, the two dispenser units 1 are associated with a dispenser head 5 which is advantageously common to both units. The dispenser head 5 includes a top bearing surface 51 which can be pressed by means of one or more fingers so as to actuate both units simultaneously. Below the bearing surface 51, the head forms two connection sleeves 52 for receiving the respective top ends of the actuator rods 34 of the two units. The two connection sleeves 52 are extended by outlet ducts (not shown) which open out in two separate dispenser orifices or in one common dispenser orifice (not shown). In addition, the dispenser head 5 includes a peripheral skirt 53 which extends freely downwards. By way of example, the free bottom end of the skirt 53 defines a peripheral retention profile 531 for co-operating with the retention means 731 formed at the top end of the sleeve 73, for example. Thus, the dispenser head 5 is temporarily held in place relative to the cup 7, and consequently, relative to the dispenser units 1. It should be observed in FIG. 1 that the actuator rods 34 of the two units are not engaged inside the connection sleeves 52. The dispenser head 5 is therefore only pre-positioned on the actuator rods 34, and is held in said position by means of the co-operation between the skirt 53 and the sleeve 73. The final position of the dispenser head 5 is achieved only after the actuator has been actuated for the first time by pressing on the bearing surface 51. During the first actuation, the thrust on the surface 51 leads to the actuator rods 34 becoming fully engaged inside the connection sleeves 52. Naturally, the temporary retention of the skirt in the sleeve 73 is terminated simultaneously. Thus, the dispenser head 5 can then be displaced freely, with its peripheral skirt 53 engaged in sliding manner inside the sleeve 73. The protective cover 9 engaged on the cup 7 also has the function of protecting the dispenser head 5 in its pre-engaged position on the dispenser units.

It should be observed that the thrust on the actuator head has the effect of pressing the bottom face of the flange 43 against the bearing surfaces 622 formed by the shell. Given that the bearing surfaces and the bottom face of the flange extend in a contact plane that is perpendicular to the axis of the thrust exerted on the head, it is impossible to remove the units from their respective housings during dispensing.

The invention makes it possible to obtain a dispenser of the dual type that is completely modular, given that each dispenser unit constitutes a distinct entity that can easily be fitted to the shell in independent and separate manner.

The invention claimed is:

1. A fluid dispenser comprising:

two distinct dispenser units (1), each comprising a fluid reservoir (20) defining an opening (23), a dispenser member (3) for taking and dispensing the fluid from the reservoir, and a fastener member (4) for fastening the dispenser member (3) on the opening (23) of the reservoir (20); and a common outer shell (6) in which at least the two reservoirs (20) are housed, the shell (6) including receiver means (62) for receiving and holding the two dispenser units (1) inside the shell, and wherein the receiver means (62) form two snap-fastener housings (620), each fastener member forming a peripheral radial flange (43) which extends outwards and which is snap-fastens in a respective housing; and in which the dispenser units are engaged in the receiver means via a top of the receiver means, such that the reservoirs penetrate firstly into the shell via the receiver means.

2. The fluid dispenser according to claim 1, wherein the dispenser further comprises blocking means (7) for blocking the dispenser units (1) in the receiver means (62).

3. A dispenser according to claim 2, in which the blocking means comprise a cup (7) fastened on the shell (6), and coming into blocked engagement with the dispenser units (1).

4. A dispenser according to claim 3, further comprising a dispenser head (5) for actuating the two units (1) simultaneously, the cup (7) forming a sleeve (73) having the dispenser head (5) slidably engaged on its inside or its outside, the sleeve (73) including retention means (731) suitable for preventing the head from being removed from the sleeve.

5. A dispenser according to claim 4, in which the dispenser head (5) is adapted to be mounted on actuator rods (34) of the respective units, the retention means (731) enabling the head (5) to be prepositioned on the actuator rods (34), the final mounting of the head on the rods taking place while the dispenser is being actuated for the first time.

6. The fluid dispenser according to claim 1, in which the receiver means (62) comprise the two housings (620), each comprising snap-fastener profiles (621) and bearing surfaces (622), each fastener member including the flange (43) defining a top face engaged with the snap-fastener profiles, and a bottom face engaged with the bearing surfaces; and a dispenser head that is displaceable by bearing axially in such a manner as to press the bottom face of the flange against the bearing surfaces.

* * * * *